US007731639B1

(12) United States Patent
Shifferaw

(10) Patent No.: US 7,731,639 B1
(45) Date of Patent: Jun. 8, 2010

(54) COMPACT WEIGHT BENCH WITH LIFTING ASSISTANCE

(76) Inventor: Tessema Dosho Shifferaw, 1019 Solano Ave., Albany, CA (US) 94706

( * ) Notice: Subject to any disclaimer, the term of this patent is extended or adjusted under 35 U.S.C. 154(b) by 0 days.

(21) Appl. No.: 12/271,547

(22) Filed: Nov. 14, 2008

(51) Int. Cl.
*A63B 21/00* (2006.01)
*A63B 21/04* (2006.01)
*A63B 21/072* (2006.01)
*A63B 23/04* (2006.01)
*A63B 23/02* (2006.01)

(52) U.S. Cl. ..... 482/92; 482/97; 482/108; 482/130; 482/138; 482/140; 482/142

(58) Field of Classification Search ..... 482/92–94, 482/104, 106–108, 121–123, 129, 130, 137, 482/138, 140, 142; 297/299, 301.1, 303.1
See application file for complete search history.

(56) References Cited

U.S. PATENT DOCUMENTS

| | | | | |
|---|---|---|---|---|
| 1,973,945 | A * | 9/1934 | Chavin et al. | 482/130 |
| 4,285,515 | A * | 8/1981 | Gezari | 482/57 |
| 5,549,535 | A * | 8/1996 | Wang et al. | 482/138 |
| 5,599,261 | A | 2/1997 | Easley et al. | |
| 5,810,702 | A | 9/1998 | Wilkinson | |
| 6,682,464 | B2 * | 1/2004 | Shifferaw | 482/106 |
| 6,716,144 | B1 * | 4/2004 | Shifferaw | 482/140 |
| 6,981,934 | B1 | 1/2006 | Shifferaw | |
| 7,112,163 | B2 * | 9/2006 | Krull | 482/104 |
| 7,137,933 | B2 * | 11/2006 | Shifferaw | 482/121 |
| 7,156,783 | B2 * | 1/2007 | Chen | 482/104 |
| 7,331,912 | B2 * | 2/2008 | Keiser et al. | 482/142 |
| 7,367,927 | B2 * | 5/2008 | Krull | 482/107 |
| 7,594,881 | B2 * | 9/2009 | Shifferaw | 482/142 |
| 2005/0266972 | A1 * | 12/2005 | Shifferaw | 482/142 |
| 2006/0035766 | A1 | 2/2006 | Towley, III et al. | |
| 2008/0076649 | A1 * | 3/2008 | Chen | 482/140 |

FOREIGN PATENT DOCUMENTS

| | | | |
|---|---|---|---|
| EP | 121902 | A1 * | 10/1984 |
| EP | 1498158 | A1 | 1/2005 |
| WO | WO 9939778 | A1 * | 8/1999 |
| WO | 2006/083867 | A2 | 8/2006 |

* cited by examiner

*Primary Examiner*—Loan H Thanh
*Assistant Examiner*—Victor K Hwang
(74) *Attorney, Agent, or Firm*—Edward S. Wright

(57) ABSTRACT

Weight bench having a frame that rests on the floor, a seat mounted on the frame, a backrest pivotally mounted on the frame to the rear of the seat for movement between horizontal, inclined, and declined positions relative to the seat, a plurality of resilient elements which can be selectively connected between the backrest and the frame for lifting the backrest toward the inclined position, a swinging arm pivotally mounted to the frame in front of the seat for movement between raised and lowered positions, a weight bar extending laterally from a free end of the swinging arm for engagement by the legs of a person doing leg exercises, a handle attached to the swinging arm for engagement by the hands of a person sitting on the seat for doing upper body and arm exercises, and weights stored in holders attached to the frame for attachment to the weight bar and for manual use in doing exercises that do not involve the weight bar.

26 Claims, 6 Drawing Sheets

48
43
47
21
37
36
42
51
40
41
35
19
34
11
12
29
14
13
31
27
28
33
16
63
17

COMPACT WEIGHT BENCH WITH LIFTING ASSISTANCE

BACKGROUND OF THE INVENTION

1. Field of Invention

This invention pertains generally to exercise and fitness equipment and, more particularly, to a compact weight bench which provides lifting assistance in doing stomach, back, and leg exercises.

2. Related Art

Exercise machines of the type commonly known as weight benches have been heretofore been provided for exercising the upper body and arms and/or the legs. Such machines tend to be somewhat complex and bulky because they generally have separate bars and weights for the upper body and arms and for the legs.

OBJECTS AND SUMMARY OF THE INVENTION

It is, in general, an object of the invention to provide a new and improved weight bench.

Another object of the invention is to provide a weight bench of the above character which overcomes the limitations and disadvantages of the prior art.

These and other objects are achieved in accordance with the invention by providing a weight bench having a frame that rests on the floor, a seat mounted on the frame, a backrest pivotally mounted on the frame to the rear of the seat for movement between horizontal, inclined, and declined positions relative to the seat, a plurality of resilient elements which can be selectively connected between the backrest and the frame for lifting the backrest toward the inclined position, a swinging arm pivotally mounted to the frame in front of the seat for movement between raised and lowered positions, a weight bar extending laterally from a free end of the swinging arm for engagement by the legs of a person doing leg exercises, a handle attached to the swinging arm for engagement by the hands of a person sitting on the seat for doing upper body and arm exercises, and weights stored in holders attached to the frame for attachment to the weight bar and for manual use in doing exercises that do not involve the weight bar.

DETAILED DESCRIPTION

Figure 1:
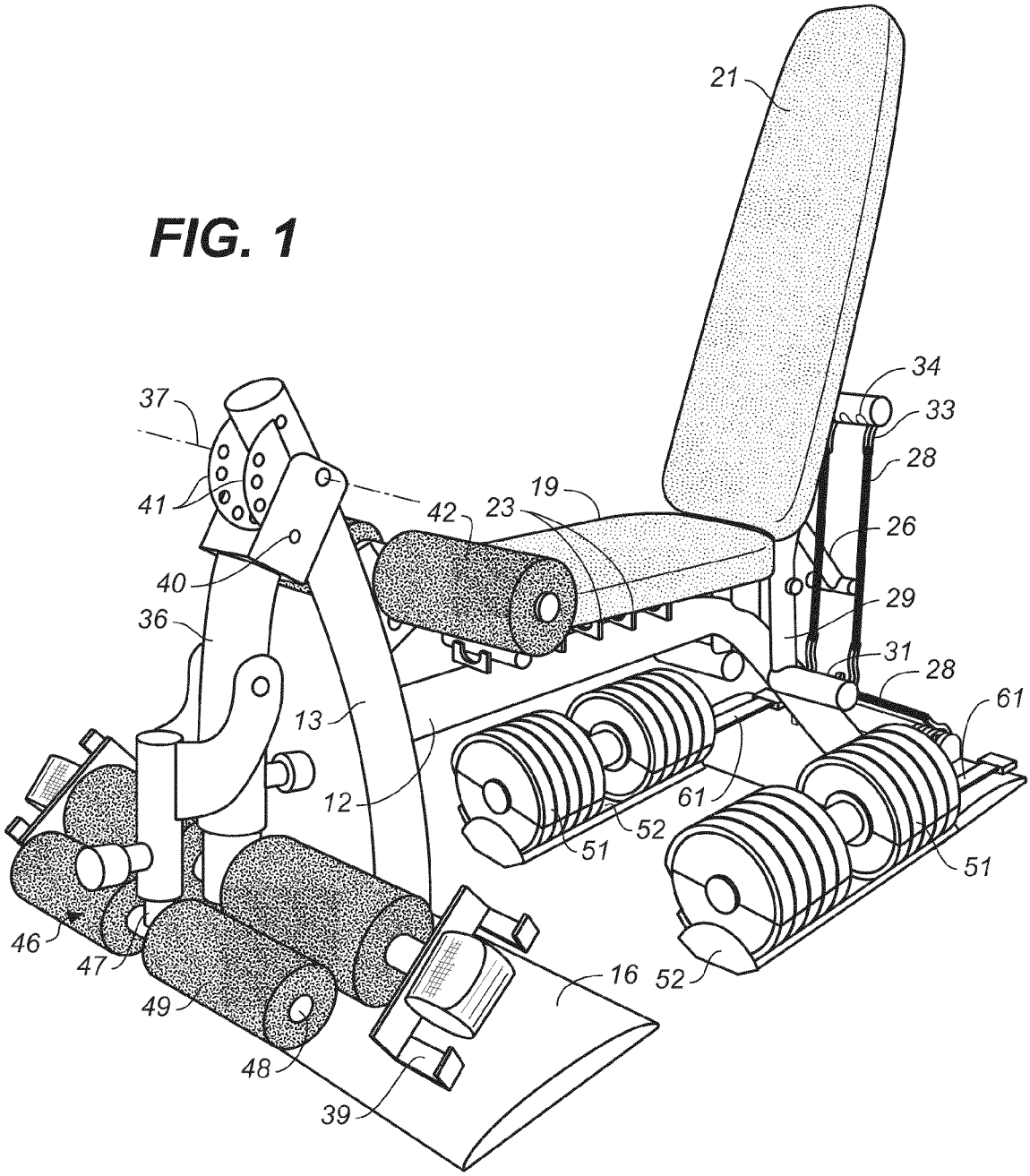
FIGS. 1-3 are isometric views of one embodiment of a weight bench incorporating the invention, with different elements in different operational positions.
Figure 2:
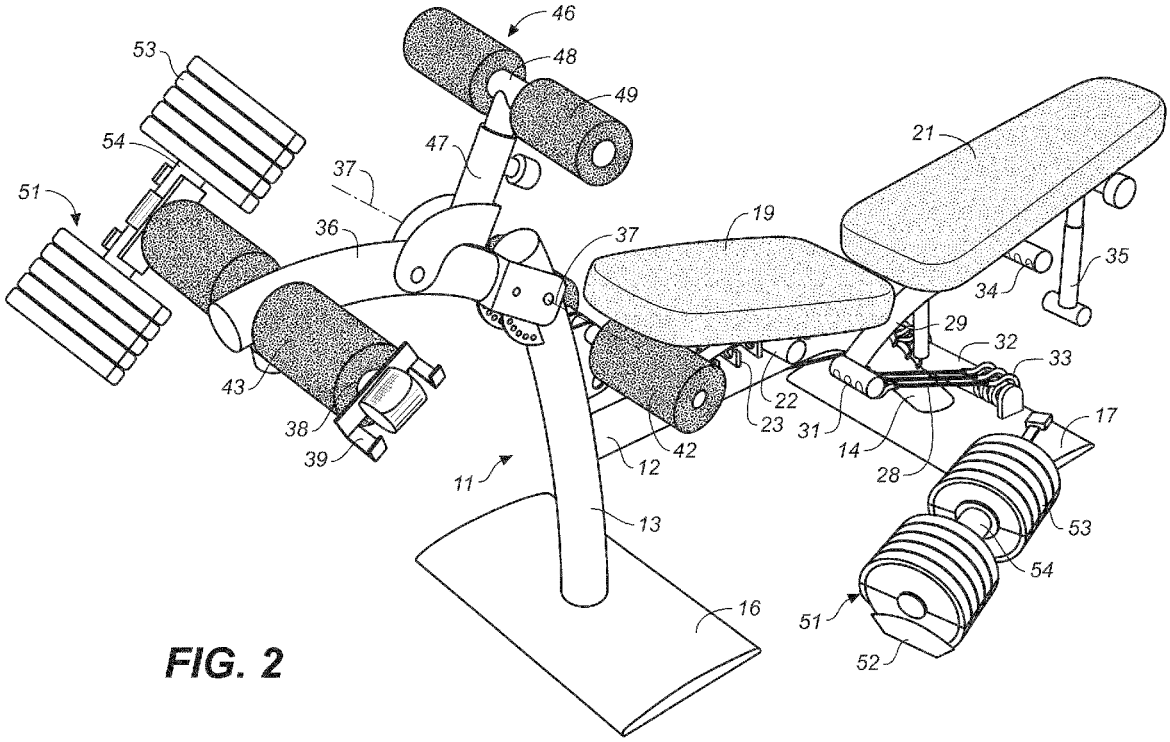
Figure 3:
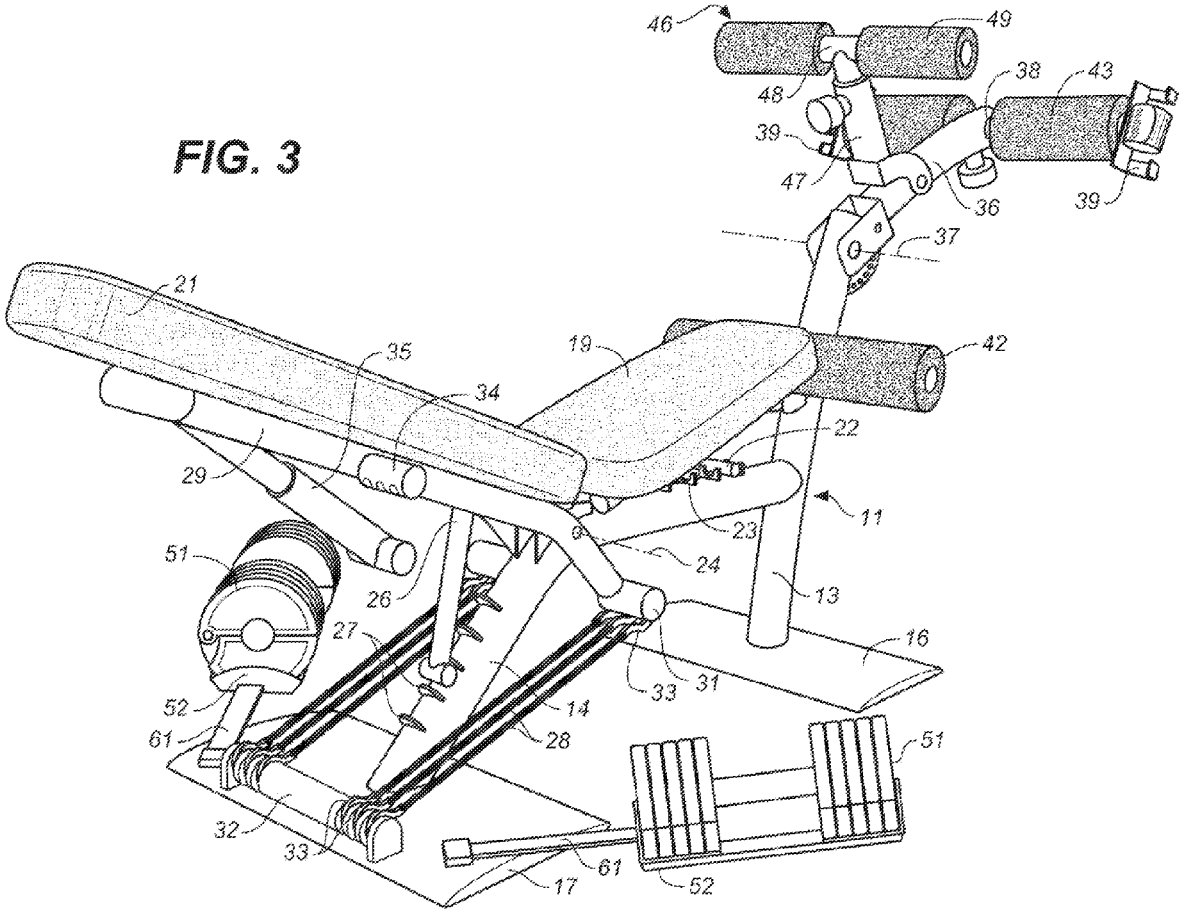
Figure 4:
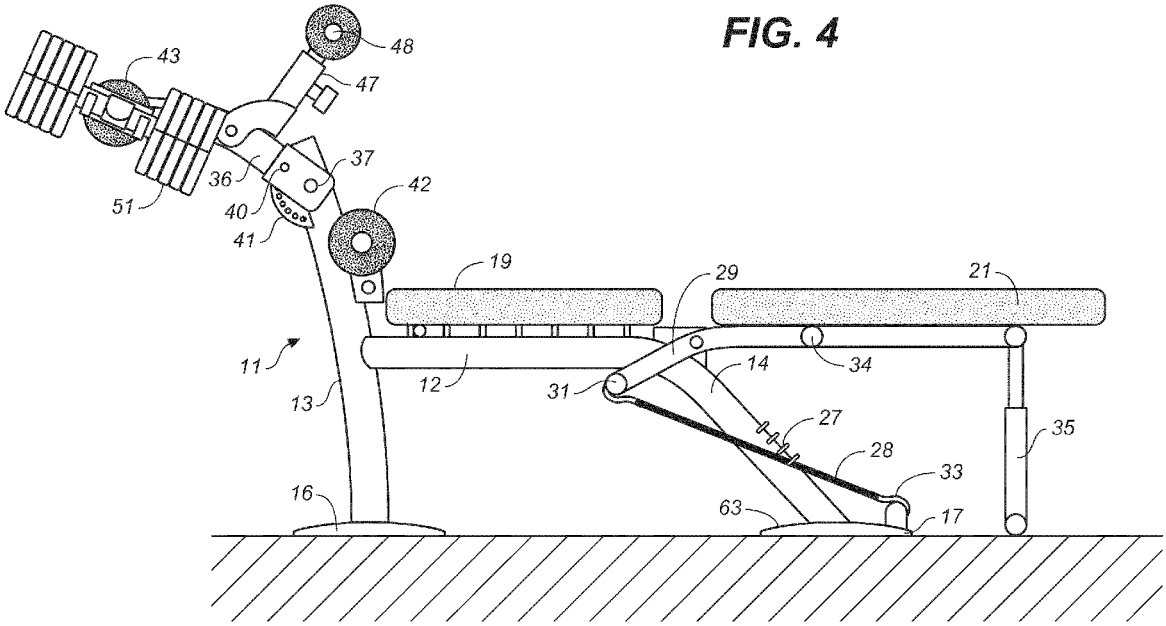
FIG. 4 is a side elevational view of the embodiment of FIGS. 1-3, with the backrest and seat in their horizontal positions.
Figure 5:
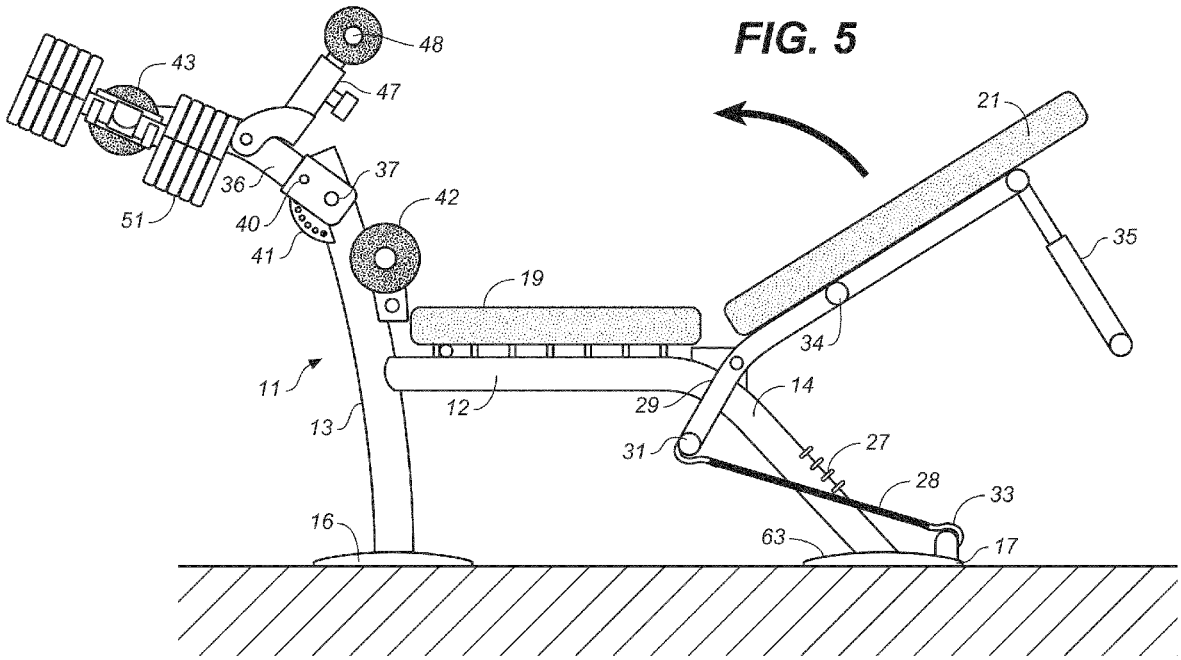
FIG. 5 is a view similar to FIG. 4, with the backrest in an inclined position.

As illustrated in the drawings, the weight bench has a frame 11 which includes a horizontally extending member 12 supported by a front post 13 and a rear leg 14, with laterally extending feet 16, 17 resting upon the floor or other supporting surface at the lower ends of the post and the rear leg. The post is somewhat curved or arched in a forward direction, and the front of the frame member is affixed to the post about half way up the post. The leg slants downwardly and rearwardly from the rear of the frame member.

A seat 19 is mounted on the frame above the horizontally extending member, and a backrest 21 is mounted on the frame to the rear of the seat. The rear portion of the seat is pivotally connected to the frame, and the front portion of the seat can be raised and supported in different positions by a prop 22 that is pivotally connected to the under side of the seat and engagable with stops 23 on frame member 12.

The backrest is pivotally mounted to the frame for movement about an axis 24 between horizontal, inclined and declined positions. A support strut 26 is pivotally connected to the backrest and engagable with stops 27 on leg 14 to support the backrest at different angles relative to the seat.

A plurality of resilient elements 28 are connected between the backrest and the frame to provide assistance in lifting. In one presently preferred embodiment, the resilient elements are elastic cords, although they could be also be springs or other suitable means for urging the backrest to pivot in an upward direction. In the embodiment illustrated, side rails 29 of the backrest extend beyond pivot axis 24, and the elastic cords are connected between the forward ends of the rails and the rear foot of the frame, with the arms acting as levers in lifting the backrest.

The elastic cords can be selectively connected between the backrest and the frame to provide the desired amount of lifting assistance. In this regard, the forward ends of the cords are connected to arms 31 which extend laterally from side rails 29 in front of the pivot axis, and the rear ends of the cords are connected to a cross bar 32 on rear foot 17, with the connections being made by hooks 33 affixed to the ends of the cords. A second set of arms 34 extend laterally from side rails 29 toward the rear of the backrest, and the rear ends of cords not in use are disconnected from cross bar 32 and connected to those arms. The front ends of the cords remain connected to arms 31, and the unused cords are thus stored on the backrest.

A leg 35 is pivotally attached to backrest for abutting engagement with the floor when the backrest is in a predetermined position such as horizontal. This leg limits the downward travel of the backrest and, thus, serves as a depth limiter for it during exercises in which the resilient elements are providing lifting assistance. It also serves to support the backrest in the predetermined position when the resilient elements are not being used.

At the front of the weight bench, a weight support arm 36 is pivotally connected to the upper portion of post 13 for swinging movement about an axis 37 on the front side of the post. A weight bar 38 extends laterally from the free end of the arm, with weight holders 39 on the ends of the bar. The weight holders are adapted for receiving the bars of dumbbells, with straps for retaining the bars in the holders. The weight support arm can be locked in different angular positions relative to the post by a pin 40 engagable between aligned openings in the arm and flanges 41 affixed to the post.

Cushioned leg rests 42 extend laterally from post 13 for supporting the upper legs of a person seated on the seat. Leg pads 43 in the form of cushions or rollers are mounted on the weight bar between arm 36 and weight holders 39 for engagement by the lower legs of a person sitting on seat 19 or standing on front foot 16.

A handle 46 is attached to weight arm 36 so that the weights mounted on the arm can be lifted by the upper body and arms of a person sitting on the seat as well as by his legs. The handle is T-shaped, with a stem 47 that is attached to the weight arm and a crossbar 48 with cushioned grips 49 that can be grasped by the hands of the exerciser. The handle is pivotally attached to the arm for movement between an operative position in which the stem extends from the arm at an angle of about 90 degrees and a storage position in which the stem is next to the arm.

Dumbbells 51 are stored in cradles 52 for attachment to weight bar 38 and for manual use by persons doing exercises that do not involve the weight bar. The dumbbells have weight plates 53 mounted on bars 54 in a manner permitting the plates to be selectively attached to and detached from the bars without removal from the cradles and without passing the plates over the ends of the bars.

Figure 6:
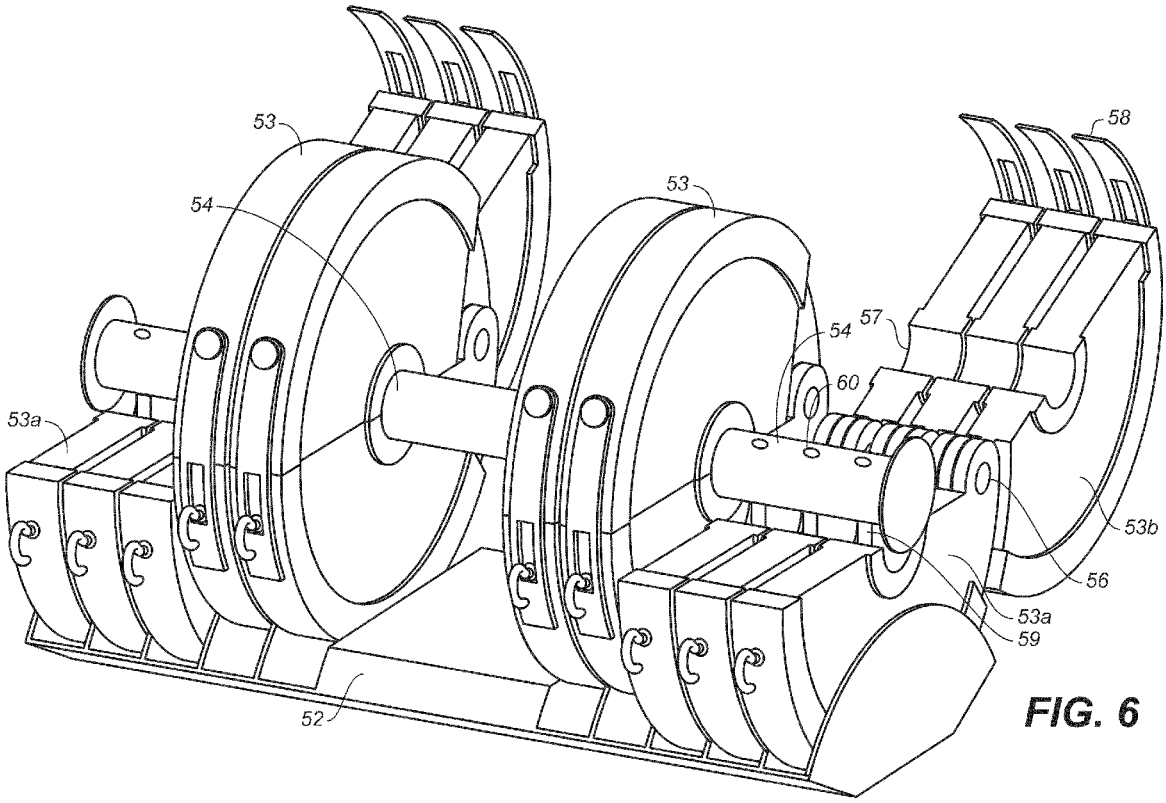
FIG. 6 is an isometric view of one of the dumbbells and weight cradles in the embodiment of FIGS. 1-3, with the dumbbell raised slightly from its rest position in the cradle to illustrate details of the structure.

As best seen in FIG. 6, the weight plates are formed in semicircular sections 53*a*, 53*b* which are connected together by hinges 56 for movement between open and closed positions. The plates have central openings 57 in which the bars are received and latches 58 for locking the plates in the closed position, with pins or lugs 59 extending from the plates for engagement with sockets 60 in the bars for preventing the plates from shifting axially or rotating on the bars. In the open or detached position, the two sections of each plate are positioned side-by-side in the cradles, with the bars resting in the semicircular openings in sections 53*a*. The weights are attached to the bars by swinging sections 53*b* to the closed position above sections 53*b* and engaging latches 58 to hold the two sections together with the plates encircling the bars. When detached from the bars, the weight plates are held upright in predetermined axial positions within the cradles.

The weight cradles rest on the floor on opposite sides of the frame are attached to the frame by arms 61. These arms are pivotally attached to rear foot 17 for swinging movement between positions adjacent to and away from the frame, and the cradles are slidably mounted on the arms for movement between extended and retracted positions. This permits the cradles to be moved to an unlimited number of different positions for storage and use of the dumbbells and where they will not interfere with the use of the bench. They can, for example, be positioned where the dumbbells can be removed from and returned to the cradles by persons sitting and reclining on the backrest and seat, or they can be swung out to the sides where they will be out of the way of persons doing other exercises.

The upper portion of rear foot 17 is inclined in a forward and downward manner to provide a footrest 63 for elevating the heels of a person doing exercises while standing on the floor and straddling the backrest.

The weight bench can be used for a variety of exercises, both with and without the dumbbells. With the dumbbells mounted in the holders at the ends of weight bar 38, a person can do exercises such as upper body and arm exercises, leg extensions, and leg curls.

For upper body and arm exercises, a person sits on seat 19, facing post 13, and gripping handle 46 with his hands. He then works the desired muscles by drawing the handle toward himself to lift the weights and pushing the handle away from himself to lower the weights.

For leg extensions, the handle is locked in its down position, and the person sits on the bench with his legs extending over leg rests 42 and behind the leg pads 43 on the weight bar. He then works his legs by lifting them against the force of the weights.

For leg curls, the person stands on one side of the post, facing toward the rear of the bench, with one foot resting on foot 16 and the calf of the other leg against the leg pad on the near side of the weight bar. He then works that leg by bending it at the knee to lift the weights.

The dumbbells can also be used as free weights in doing exercises both on and off the bench. For, example, a person can do exercises such as shoulder presses, lateral raises, and arm curls while sitting on the seat with the backrest in an upright position and his back against the backrest. Exercises such as bench presses and lateral flys can be done with the backrest and seat in their horizontal positions and the exerciser reclining on the backrest, with his buttocks on the seat and his feet on the floor in front of the seat. Similar exercises can also be done with the backrest in an inclined or declined position. If desired, the resilient cords can be connected between the backrest and frame to assist the lifter in lowering his back to the horizontal and declined positions as well as raising it up from those positions.

Leg squats can be performed with lift assistance by extending leg 35 to limit downward movement of the backrest and engaging the resilient cords to urge the backrest toward its upright position. The exerciser stands on the floor, facing forward, with his heels resting on footrest 63, his legs straddling the backrest, his arms hanging down at his sides, the dumbbells in his hands, and the backrest in the upright against his backside. As he bends his knees and moves from the standing position to a sitting position, the backrest is pressed down against the force of the cords until it reaches the horizontal position and leg 35 abuts against the floor. As he straightens his legs to return to the upright position, the cords assist him in doing so.

For exercises such as inclined arm curls and overhead arm extensions which require inclined or upright back support and a shorter backrest and/or additional room in front of the exerciser, the backrest can be moved to its horizontal position and the seat to an inclined or upright position, with the exerciser sitting on the backrest facing toward the rear of the bench and his back against the seat.

The bench can also be used to provide assistance in exercises such as abdominal crunches and reverse crunches. For standard abdominal crunches, leg 35 is extended to limit downward movement of the backrest to the horizontal position, and the resilient cords are engaged to urge the backrest toward its upright position. The exerciser sits on the seat and slowly lowers his back against backrest until the backrest reaches the horizontal position, then he slowly raises up to a 45 degree crunch position, with cords assisting him in doing so.

For decline crunches, leg 35 is locked against the underside of the backrest, and strut 26 is positioned for engagement with the stop 27 on leg 14 corresponding to the desired angle of declination to limit travel of the backrest in the downward direction.

For reverse crunches, leg 35 is once again deployed to limit downward movement of the backrest to the horizontal position, and the exerciser reclines on the backrest and seat with his head toward the post, his lower back resting on the backrest, and his legs extending in an upward direction. He then tightens his abdominal muscles and rolls his hips toward his ribs until he reaches a crunch position with the backrest inclined at an angle of about 45 degrees and the resilient cords assisting him in lifting his hips. He then slowly returns to the starting position, with the resilient cords once again assisting him in doing so.

The amount of weight on the dumbbells is adjusted by changing the number of plates on the bars. To add or remove plates, the dumbbells are returned to the weight cradles, with the bars resting in the semicircular openings in sections 53*a*. Plates are attached to the bars by swinging sections 53*b* into position above sections 53*a* and engaging latches 58 and pins 59 to secure the plates to the bars. Plates are detached by disengaging the latches and swinging sections 53*b* to the open position beside sections 53*a*. When the dumbbells are removed from the cradles, the detached plates remain behind in the open position in the cradles.

The invention has a number of important features and advantages. It allows the arms, legs, and other parts of the body to be exercised with a single set of weights, and It can also be utilized in doing exercises that do not involve weights. Both the backrest and the seat can be moved between horizontal and inclined positions, and the backrest can also be moved to declined positions. With resilient cords urging the backrest toward an upright position, the backrest can provide lifting assistance for exercises such as abdominal crunches and leg squats.

It is apparent from the foregoing that a new and improved weight bench has been provided. While only certain presently preferred embodiments have been described in detail, as will be apparent to those familiar with the art, certain changes and modifications can be made without departing from the scope of the invention as defined by the following claims.

The invention claimed is:

1. A weight bench comprising a frame that rests on the floor, a seat mounted on the frame, a backrest pivotally mounted on the frame to the rear of the seat for movement between horizontal, inclined, and declined positions relative to the seat, a plurality of resilient elements selectively connected between the backrest and the frame for lifting the backrest toward the inclined position, a swinging arm pivotally mounted to the frame in front of the seat for movement between raised and lowered positions, a weight bar extending laterally from a free end of the swinging arm for engagement by the legs of a person doing leg exercises, a handle attached to the swinging arm for engagement by the hands of a person sitting on the seat for doing upper body and arm exercises, and weights stored in holders attached to the frame for attachment to the weight bar and for manual use in doing exercises that do not involve the weight bar.

2. The weight bench of claim 1 wherein the weights are dumbbells having weight plates mounted on bars which can be attached to the weight bar or gripped by the hands of persons doing exercises that do not involve the weight bar.

3. The weight bench of claim 2 wherein the holders in which the weights are stored include cradles in which the dumbbells are received with the weight plates resting in upright positions.

4. The weight bench of claim 3 wherein the weight plates are formed in sections which are hinged together for movement between open positions in which the bars can be lifted away from the plates and closed positions in which the plates encircle the bars.

5. The weight bench of claim 1 wherein the holders for the weights rest on the floor and are attached to the frame by arms which permit the holders to be moved to different positions.

6. The weight bench of claim 5 wherein the weight holders are slidably attached to the arms, and the arms are pivotally connected to the frame.

7. The weight bench of claim 1 wherein one end of each of the resilient elements is connected to the backrest and a second end of each resilient element is movable between an operative position in which second end is connected to the frame and a storage position in which the second end is connected to the backrest.

8. The weight bench of claim 1 wherein the resilient elements are elastic cords.

9. The weight bench of claim 1 including a leg extending from the backrest and engagable with the floor to support the backrest in the horizontal position and to prevent the backrest from declining beyond the horizontal position.

10. The weight bench of claim 1 including a support engagable between the backrest and the frame for supporting the backrest at different angles relative to the seat.

11. The weight bench of claim 1 wherein the seat is pivotally mounted on the frame and adjustable between horizontal and inclined positions.

12. The weight bench of claim 1 including a footrest toward the rear of the frame for elevating the heels of a person doing exercises while straddling the backrest.

13. A weight bench comprising a frame, a seat mounted on the frame, a backrest pivotally mounted on the frame to the rear of the seat for movement between horizontal, inclined, and declined positions relative to the seat, a plurality of resilient elements selectively connected between the backrest and the frame for lifting the backrest toward the inclined position, a support engagable between the backrest and the frame for supporting the backrest at different angles relative to the seat, a leg engagable with the floor for supporting the backrest in the horizontal position and preventing the backrest from declining beyond the horizontal position, and dumbbells stored in holders attached to the frame in positions such that the dumbbells can be removed from the holders and used by persons sitting and reclining on the backrest and seat.

14. The weight bench of claim 13 wherein the support and the leg are pivotally connected to the backrest for movement between storage and supporting positions.

15. The weight bench of claim 13 wherein the dumbbells include weight plates mounted on bars in a manner permitting the weight plates to be attached to and detached from the bars without passing over the ends of the bars, and the holders include cradles in which the dumbbells are received with the weight plates resting in upright positions.

16. The weight bench of claim 15 wherein the weight plates are formed in sections which are hinged together for movement between open positions in which the bars can be lifted away from the plates and closed positions in which the plates encircle the bars.

17. The weight bench of claim 13 wherein the holders for the weights rest on the floor and are attached to the frame by arms which permit the holders to be moved to different positions.

18. The weight bench of claim 17 wherein the weight holders are slidably attached to the arms, and the arms are pivotally connected to the frame.

19. The weight bench of claim 13 including a footrest toward the rear of the frame for elevating the heels of a person doing exercises while straddling the backrest.

20. A weight bench comprising a central, horizontally extending frame member supported at opposite ends by an upstanding post and a downwardly and rearwardly inclined leg, a rear cross member extending bilaterally from the leg, a seat mounted on the frame member, a back rest pivotally mounted to the rear of the seat for movement between horizontal, inclined, and declined positions relative to the seat, and a plurality of resilient elements selectively connected between the backrest and the rear cross member for lifting the backrest toward the inclined position.

21. The weight bench of claim 20 wherein each of the resilient elements has a first end connected to the backrest and a second end which can be selectively connected either to the backrest or to the cross member.

22. The weight bench of claim 20 including a support engagable between the backrest and the inclined leg for supporting the backrest at different angles relative to the seat, and a leg engagable with a surface on which the bench is resting for supporting the backrest in the horizontal position and preventing the backrest from declining beyond the horizontal position.

23. The weight bench of claim 20 including dumbbells stored in holders which are pivotally and slidably attached to the rear cross member for movement to positions where the dumbbells can be removed from the holders used by persons sitting and reclining on the backrest and seat.

24. The weight bench of claim 23 wherein the dumbbells include weight plates mounted on bars in a manner permitting the weight plates to be selectively attached to and detached from the bars without removing the dumbbells from the holders.

25. The weight bench of claim 24 wherein the weight plates are formed in sections which are hinged together for movement between open positions in which the bars can be lifted away from the plates and closed positions in which the plates encircle the bars.

26. The weight bench of claim 20 wherein the rear cross member rests on a supporting surface and includes a footrest for elevating the heels of a person doing exercises while standing on the supporting surface and straddling the backrest.

* * * * *